United States Patent [19]

Carr

[11] 4,057,273

[45] Nov. 8, 1977

[54] CONTAINER DOOR SECURING MECHANISM

[75] Inventor: George W. Carr, Albuquerque, N. Mex.

[73] Assignee: Pullman Incorporated, Chicago, Ill.

[21] Appl. No.: 625,789

[22] Filed: Oct. 24, 1975

[51] Int. Cl.[2] ..... E05C 9/08

[52] U.S. Cl. ..... 292/218; 292/DIG. 30; 292/207

[58] Field of Search ..... 292/218, 207, 208, 54, 292/302, DIG. 30

[56] References Cited

U.S. PATENT DOCUMENTS

| | | | |
|---|---|---|---|
| 1,579,107 | 3/1926 | Hanle | 292/207 X |
| 2,403,993 | 7/1946 | Nyhus | 292/207 X |
| 2,751,858 | 6/1956 | Koranda et al. | 292/259 X |
| 3,132,893 | 5/1964 | Herr et al. | 292/218 X |
| 3,255,554 | 6/1966 | Spaeth et al. | 292/218 X |
| 3,434,751 | 3/1969 | Tantlinger et al. | 292/218 |
| 3,830,537 | 8/1974 | Brindle | 292/259 |

*Primary Examiner*—Richard E. Moore

[57] ABSTRACT

A container with hinged doors is provided with an improved locking bar arrangement including square and rectangular locking bars. The locking bars are rotated between open and locked positions by a locking pin or hinged handle which is removable from a bar interlock position to selectively engage apertured tubular gathering members provided on the bars for rotating them into the positions selected. Slide bolt assemblies also are movable into locking engaging position with the bars. The bars include camming means and keeper members are provided on the container which facilitate the opening and closing of the doors and which with the associated structure contributes to the total strength of the door assembly and in the stabilization of the container.

17 Claims, 13 Drawing Figures

CONTAINER DOOR SECURING MECHANISM

BACKGROUND OF THE INVENTION

1. Field of the Invention

The invention pertains to containers or trailer bodies which are provided with swinging doors and more specifically it relates to the door closing mechanism of the rotating bar type for locking the swinging doors in either open or closed positions.

2. Description of the Prior Art

Patents of interest in the prior art include U.S. Pat. Nos. 1,728,530 Sept. 17, 1929; 1,956,679, May 1, 1934; 1,989,808 Feb. 5, 1935; 2,260,519 Oct. 28, 1941. In these patents the swinging doors of containers are moved between open and closed positions and securely locked by means of vertical operating bars having certain types of mechanisms usually consisting of levers for turning and locking the operating bars. The operating bars can comprise solid rods or in many instances are of tubular construction. In the present invention the operating bars are of tubular rectangular and square construction for reasons which will follow.

SUMMARY

It is the prime object of the present invention to provide an improved bar type operating mechanism for swinging doors of containers. The operating bars of the prior art have generally been of cylindrical construction, such as rods or tubes. In the present invention the operating bars are constructed of rectangular design configuration and also intermediate bars are constructed of square tubing. The rectangular bars which are located at the innermost edges of the swinging doors are maintained in a locked position by means of slide bolts which are laterally slidable into openings provided in the bars for preventing their rotation. Further, each of the rectangular bars is provided with gathering members which in the closed position lie between the bars and which are in alignment and through which a vertically removable locking pin is inserted. The locking pin further provides for a positive manual interlock of the locking bars to prevent their rotation from the closed position. The gathering members also are suitably apertured and during opening and closing the removable locking pin is removed and is inserted in the apertures thereby permitting rotation by the operator of the locking bars by means of the locking pin. The locking bars also are connected to the surfaces of the door by means of a novel hinge arrangement which is particularly adaptable to any type of square or rectangular tubing which is used in the construction of the locking bars. The lower and upper edges of the locking bar are also provided with an improved cam foot means which is adapted to engage a novel keeper construction so that the doors can be easily and firmly locked in position as desired.

DESCRIPTION OF THE PREFERRED EMBODIMENT

Figure 1:
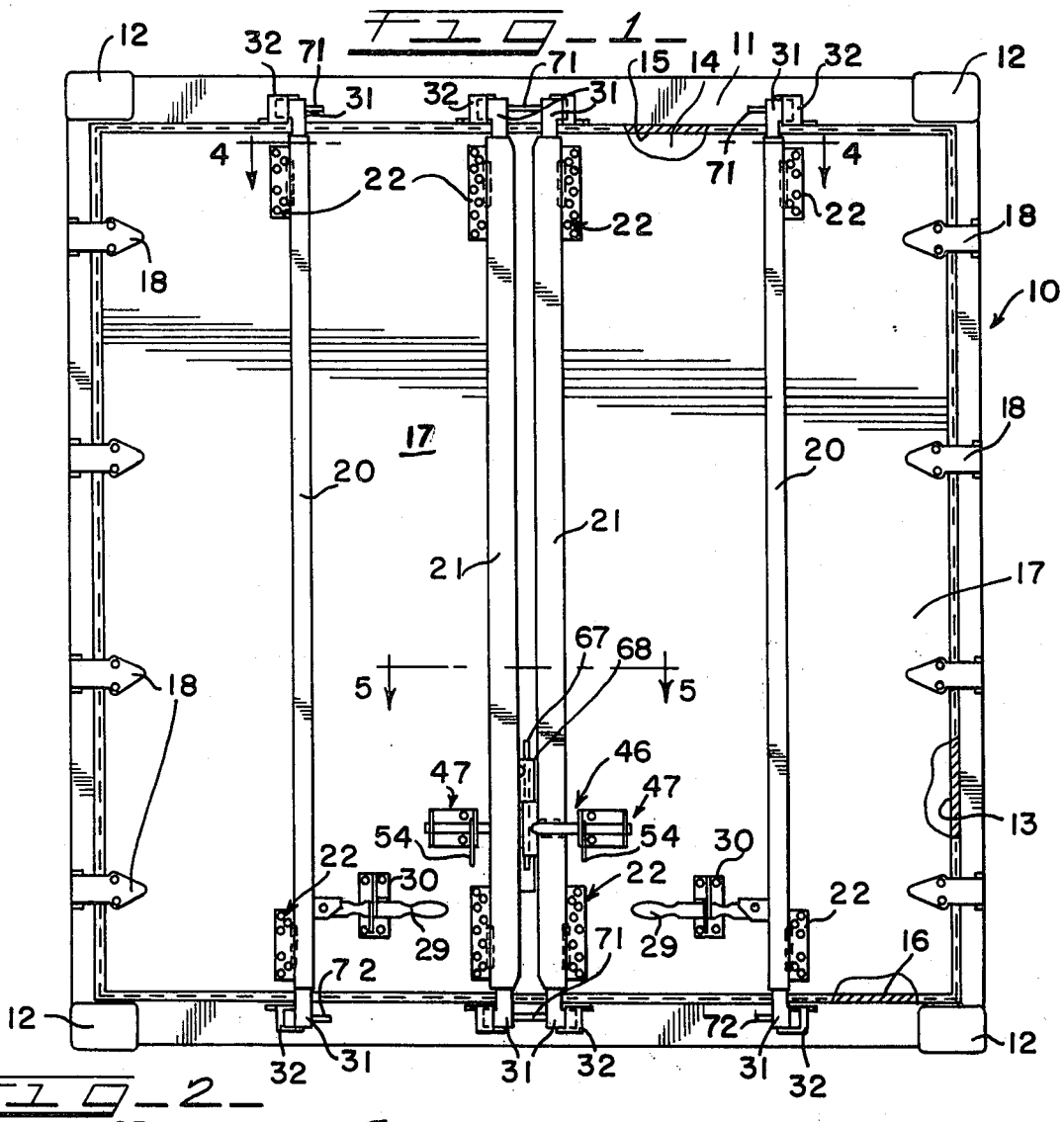
FIG. 1 is a rear elevational view of a container having swinging doors and including an improved door operating mechanism.
Figure 2:
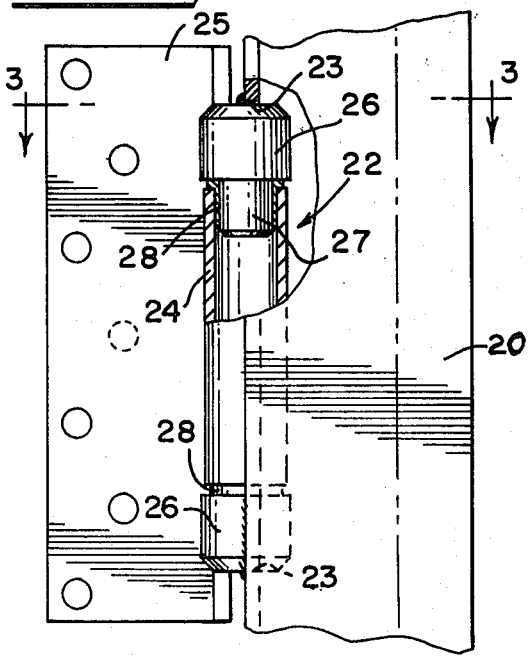
FIG. 2 is an enlarged detailed view of a hinge construction for the swinging doors of a container.
Figure 3:
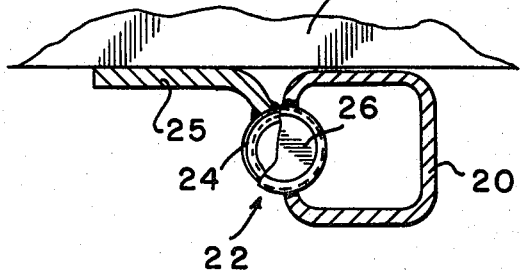
FIG. 3 is a cross sectional view taken substantially along the line 3—3 of FIG. 2.
Figure 4:
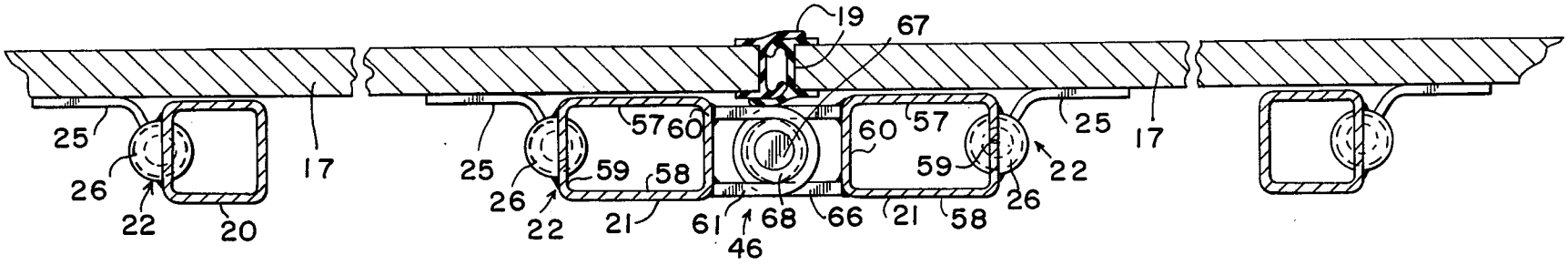
FIG. 4 is a cross sectional view taken substantially along the line 4—4 of FIG. 1.
Figure 5:
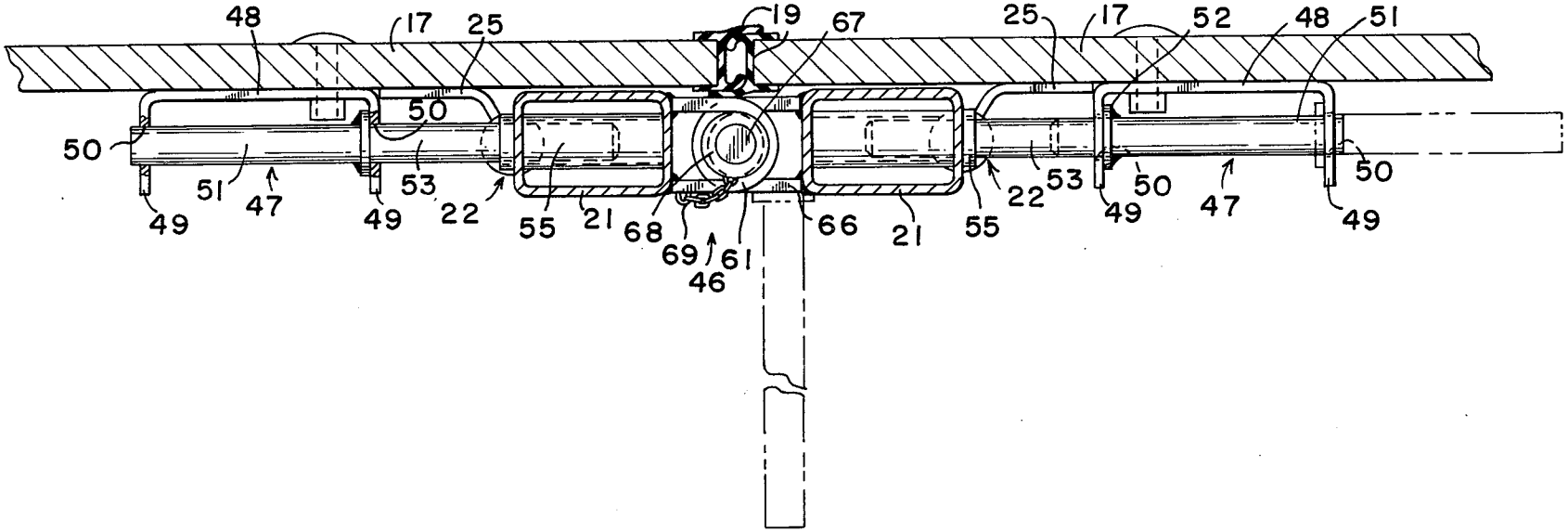
FIG. 5 is a cross sectional view taken substantially along the line 5—5 of FIG. 1.

Referring particularly to FIG. 1, a container or trailer body 10 includes an end frame structure 11 provided at its four corners with corner castings 12 of conventional construction. The present invention may be utilized with any type of container utilized in handling of cargo. Such containers may be mounted on over-the-road chassis or they may be integral parts of a trailer body. The present container 10 includes inner vertical walls 13, a cargo loading opening 14, an inner upper wall 15, and a lower or bottom wall 16. Conventional swinging doors 17 are adapted to be moved outwardly for loading or unloading the interior of the container 10. The swinging doors 17 are suitably hingedly connected to the frame structure 11 by conventional hinge brackets 18. As best shown in FIGS. 4 and 5, inner edges of the door 17 also include interengaging flexible edge seals 19, also of conventional design. Each of the swinging doors 17 is provided with intermediately located operating bars of generally square configuration, as best shown in FIGS. 4 and 5. Adjacent to the inner edges of the swinging doors 17 there are located vertically extending operating bars of rectangular configuration, the same being designated at 21. The operating bars 20 and 21 are secured to the door 17 by means of hinge assemblies 22. As best shown in FIG. 2, each of the operating bars 20 are provided with a vertical slot 23. A tubular hinge member 24 is rigidly connected to a hinge plate 25 secured to the door 17. A tube 24 is positioned within the slot 23 by means of upper and lower hinge plugs 26 each having reduced bearing portions 27 supporting bushings 28 engaged within the upper and lower ends of the tubular hinge member 24. As best shown in FIG. 1, the intermediate operating bars 20 are suitably connected to a hinged locking handle 29 adapted to be locked in position by means of a bracket 30 supported on the door 17. The handle 29 and retaining bracket 30 are of conventional design and are shown and described in the aforementioned patents of the prior art. The hinges above described and associated structure also are provided on each of the rectangular bars or rods 21.

Figure 11:
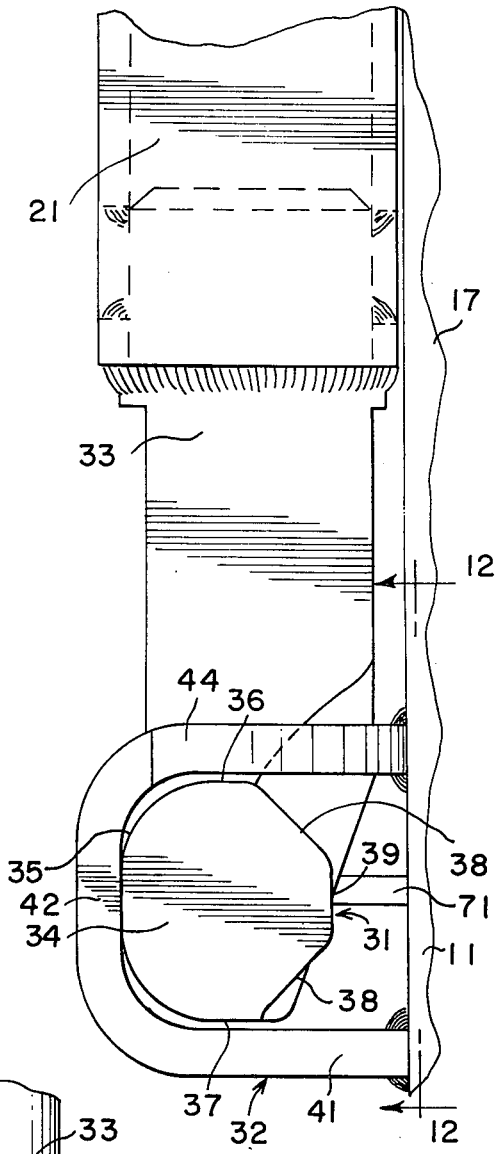
FIG. 11 is a cross sectional view enlarged showing a cam foot arrangement taken substantially along the line 11—11 of FIG. 10.

As best shown in FIGS. 1, and 10 through 13, the operating rods 20 and 21 are provided with upper and lower cam means generally designated at 31. The cam means 31 are adapted to be placed into locking engagement with keeper means 32 supported on the container frame structure 11. Each of the cam means 31 includes a vertical leg 33 having a laterally extending foot 34 connected thereto. Each foot includes a vertical curved wall member 35, and upper wall 36, a lower wall 37 and tapering gathering edge wall 38 meeting in a central vertical wall 39 as best shown in FIG. 11.

Figure 12:
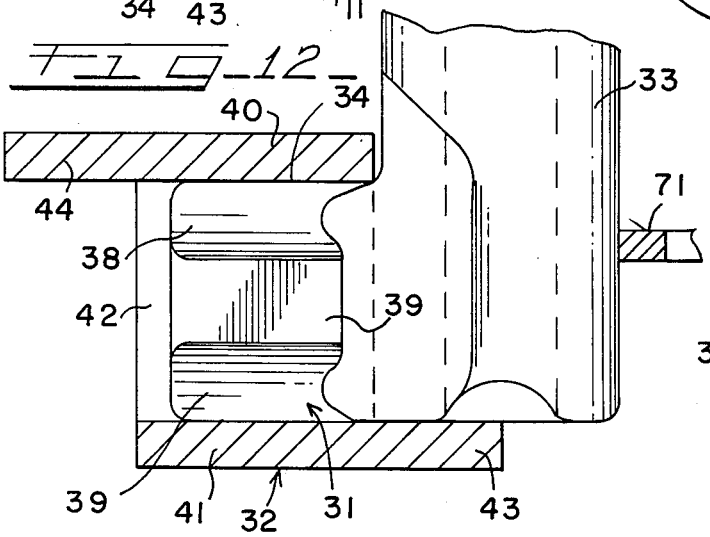
FIG. 12 is a cross sectional view taken substantially along the line 12—12 of FIG. 11.
Figure 13:
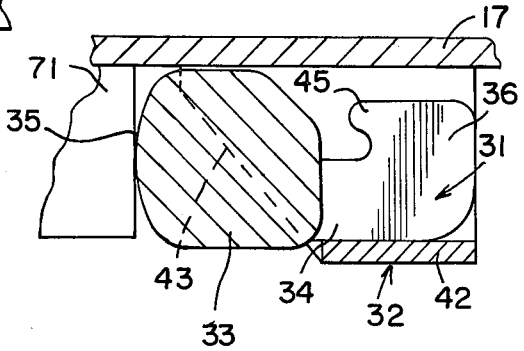
FIG. 13 is a cross sectional view taken substantially along the line 13—13 of FIG. 10.

Each keeper means 32 is provided with an upper wall 40, and a lower wall 41, connected by a vertical wall 42. The upper and lower walls 41 are suitably connected to the frame structure 11. As best shown in FIGS. 11, 12 and 13, the lower wall 41 includes a diagonal extension 43 and the upper wall 40 includes a diagonal extension 44. The foot 34 is provided with a hook shaped toe 45, as best shown in FIG. 13.

Figure 6:
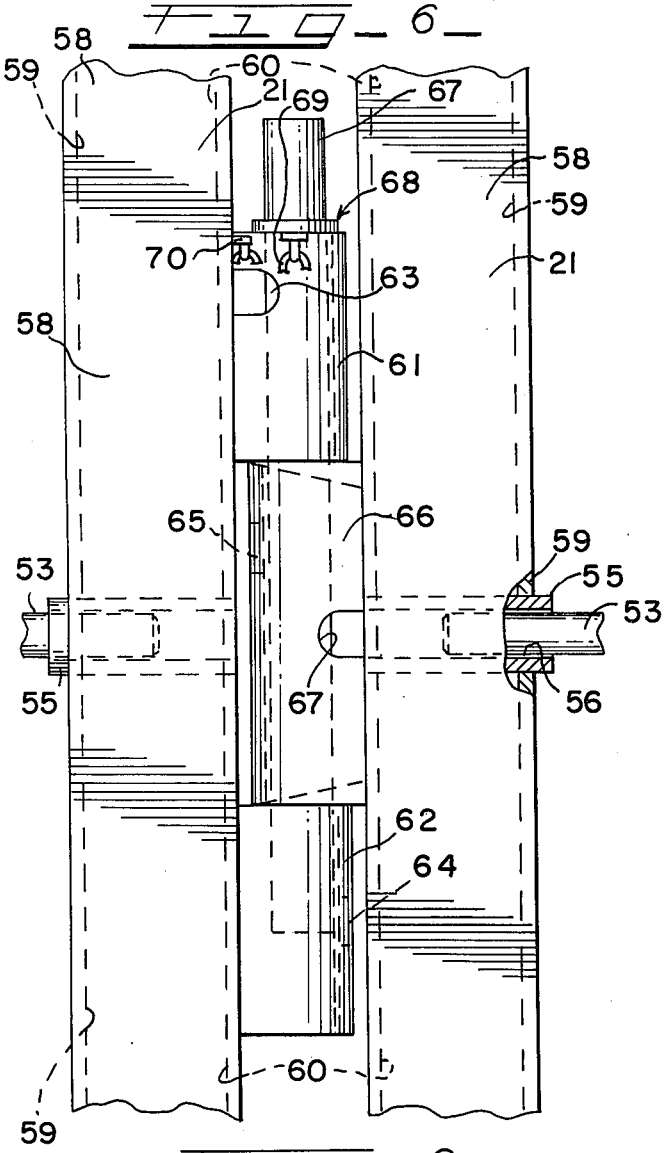
FIG. 6 is an enlarged detail elevational view, partially in section, showing a locked position of portions of a locking bar.
Figure 9:
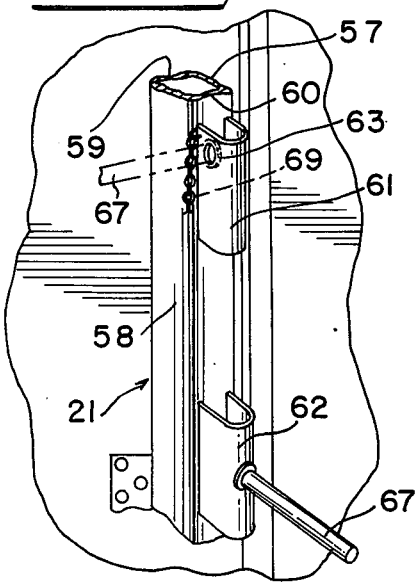
FIG. 9 is a detailed perspective view of one of the locking bars disclosing the adaptation of a removable locking pin.
Figure 8:
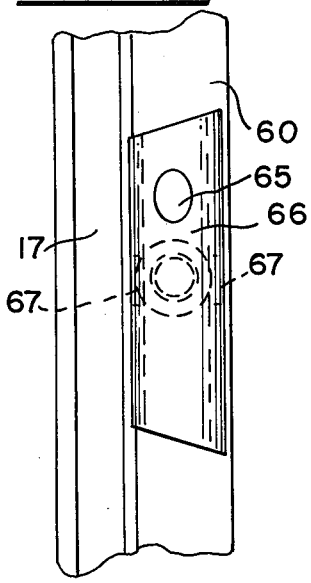
FIG. 8 is a side elevational view of a portion of the locking bar on the right hand side in FIG. 6.
Figure 10:
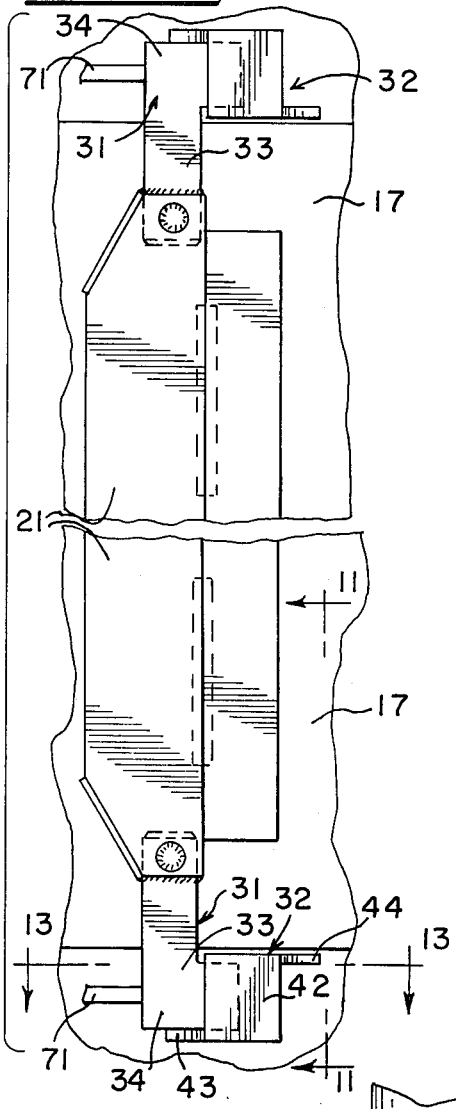
FIG. 10 is an elevational view of a door portion disclosing a locking bar and particularly the upper and lower cam feet engageable with keeper member supported on a container.

Referring now particularly to FIGS. 1, 4, 5 and 6 through 9, a locking arrangement 46 includes slide bolt assemblies 47 supported on the door 17. Each slide bolt assembly 47 includes a U-shaped bracket 48 having outwardly projecting flanges 49 provided with aligned openings 50. A slide bolt 51 is supported on each of the brackets 48 within the openings 50. Each slide bolt includes a stop and handle arrangement 54 which limits the sliding movement of the bolt 51. Each of the rectangular tubes 21, as best shown in FIG. 5, is provided with a tube 55 suitably supported therein and projecting outwardly with respect thereto so as to be engaged in locking relation when the bolt ends 53 are moved to their locking position. As best shown in FIG. 6, the tube 55 projects outwardly through an opening 56 in the bar 21 and the bolt end 53 is inserted within the tubing in the locked position. Specifically, each of the rectangular tubes 21 include walls 57, 58, 59 and 60, as best shown in FIG. 9. The openings 56 are provided in the wall 59.

Figure 7:
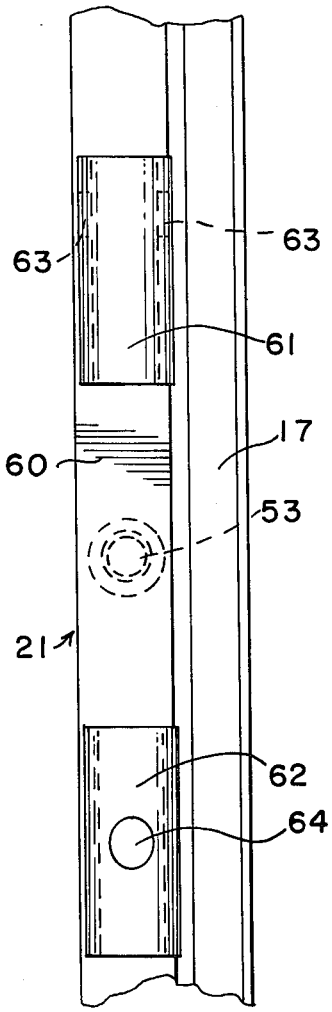
FIG. 7 is a side elevational view of a portion of the locking bar located on the left hand side of FIG. 6.

Referring now particularly to FIGS. 6 and 7, one of the walls 60 of one of the bars 21 supports a pair of vertically spaced U-shaped tubular lock or gathering members 61 and 62. The locking member 61 is provided with aligned apertures 63 at the upper ends thereof. The locking member 62 is provided with a hole 64, as best shown in FIG. 7. A central U-shaped lock or gathering member, also of tubular configuration, is designed at 66 and includes a hole 65. The member 66 is rigidly connected to the wall 60 of the other operating bar 21. As best shown in FIG. 6 in the locked position of the bars 21 the gathering member 66 is disposed between and engaged with the gathering members 61 and 62. As best shown in FIGS. 4, 5 and 6, a locking pin 67 includes a head 68 and is connected by means of a chain 69 to an anchoring tab 70 provided on the left hand operating bar 21, as shown in FIG. 6.

THE OPERATION

Assuming now that the doors 17 are in the open position permitting entrance to the interior of the container, the closing operation is as follows:

Referring to FIG. 1, the left hand door is first moved to a closed position. At this point the locking pin 67 has been removed from the gathering members 61, 62 and 66. The locking pin 67 is now first inserted into the opening 64, as shown in the lower portion of FIG. 9, and the operating bar 21 is rotated on its hinges. Such rotation provides for the engagement of the upper and lower cam means 31 with the keepers 32 drawing the door partially tightly against the frame structure. The locking pin 67 is removed from the opening 64 and then inserted through the aperture 63, as shown in the upper end of the view in FIG. 9, and the rotation of the locking bar 21 is finalized so that the left hand door is now tightly closed. The operator then moves the slide bolt assembly on the left hand door 17 wherein the left hand bolt end 53 is engaged with the tube 55, as shown in FIG. 6. The locking pin is then removed from aperture 63, thus the left hand door 17 is now locked in position. The right hand door 17 is now hingedly moved to a closed position and the locking pin 67 is initially inserted into the opening 65 shown in FIG. 8, whereupon the right hand bar 21 is initially rotated to a locked position. The locking pin 67 is then removed from the opening 65 and is inserted into and through the aperture 67 whereupon further rotation of the locking bar causes finalized rotation of the tube 21 to the closed position shown in FIG. 6. The other bolt end 53 has been moved into the locked position engaging the right hand tube 55, as best shown in FIG. 6. Thus it can readily be appreciated that the slide bolts firmly and effectively prevent any inadvertent rotation of the bars 21 from their lock position. The locking bar 67 is then removed and since the gathering members 61, 62 and 66 are in vertical alignment, the operator simply inserts the locking bar 67 through the said members, thus also further locking the bars 21 firmly in position. The locking pin 67 also performs the additional function of an additional locking means. In this manner the doors can be firmly closed against the frame structure and the seals 19 are effectively placed into sealing and compressed relation. To release the doors to their open position the locking pin 67 is removed and the slide bolts are merely actuated to the open position whereupon the doors are free to open. The U-shaped members 61, 62 and 66 together with the cam means 31 and keeper means 32 are designed mainly to take vertical shear forces.

The unique construction of the camming and keeper means is disclosed particularly in FIGS. 10 through 13. The extensions 43 and 44 of the keeper means are provided in order to increase the strength of the connection to the frame of the container. As best shown in FIG. 1, stop plates or blocks 71 are rigidly connected to the frame structure of the container and are disposed between the upper and lower camming means of bars 21. Similarly, stop blocks 72 are provided at the camming means 31 of the bars 20. As best shown in FIG. 13 the curved wall 35 assists in the guiding of the foot 34 into and out of engagement with the keeper into the engaged and dis-engaged positions.

The primary objective of the invention is to strengthen the locking mechanism which in turn strengthens the door and the container. The primary problems of container operations from the structural basis has to do with the fact that loads have a tendency to shift longitudinally against the door and therefore the door has to be of extremely strong construction and in turn the door mechanism must be able to strengthen the door thereby strengthening the entire container construction. Further problems in containers is the parallelogram forces which cause twisting of the container unless it is firmly held in against these forces by the locking mechanism and the doors. Parallelogramming is caused by horizontally or laterally directed forces which cause shifting movement of the upper end of the container relative to its lower end. In other words, these forces cause the vertical walls to move laterally outwardly with respect to their lower ends unless properly restrained, such movement, of course, can cause premature destruction of the container. Thus, the door constructions and locking mechanism perform the additional function of stabilizing the container and must, therefore, be designed to accommodate these shifting loads and the parallelogramming forces. The conventional solid or tube locking rods continually have increased in size in view of the increased loading and these have recently reached their capacity. In certain instances some of the additional forces have been accommodated by additional beams and necessary reinforcements. This, however, did not achieve the desired results since the locking mechanism remained weak. Mechanisms connecting the door to the frame at the top and bottom ends still produced weak areas and the maximum section of the circular rod had to be necessarily limited. Present design requirements, therefore, now dictate that the bars or rods must be made sufficiently strong to restrain parallelogramming as well as accommodate the increased shifting forces of the load in a longitudinal direction. The present invention provides this by the utilization of the rectangular and square rods or bars which may be made sufficiently strong to achieve the desired results without interferring with design requirements and ease of operation in opening and closing of the doors.

In the present invention the greatest forces are in the middle or at the edges where the two doors join and in this case the rectangular tubing is used. The intermediate bars may be of square or rectangular tubing since the forces at this point are somewhat less. The need of rectangular or square bars is determined by the load on the door. The width of rectangular bars are also determined by the loading on the doors. In the case of prior art arrangement wherein bars of cylindrical construction, such as rods or tubes are used considerable reinforcement of the door is necessary. Use of rectangular tubing eliminates additional reinforcement. One of the distinct advantages of the square or rectangular tubing is that they are designed to take the vertical shear loads. The locking rod arrangement with the gathering members also assures additional locking arrangement in addition to that which is afforded by the sliding bolt assemblies. This also provides for a much stronger construction in turn assisting the doors in achieving the necessary restraint to accommodate the forces resulting from load shift and parallelogramming. Further, the novel locking arrangement provides for a secure and efficient lock which can quickly be operated and which, when locked, assures maximum safety that can be achieved. Further, the novel design of the cam action foot of the camming means including the gathering surfaces assure ease of closing and extreme tightness when closed. Further, the vertical engagement of the feet with the upper and lower walls is such that tight locking results and upward relative movement between the camming feet rods and the keeper member is prevented.

The foregoing description and drawings merely explain and illustrate the invention and the invention is not limited thereto, except insofar as the appended claims are so limited, as those skilled in the art who have the disclosure before them will be able to make modifications and variations therein without departing from the scope of the invention.

What is claimed is:

1. A container having a loading opening including a pair of hinged doors swingable outwardly from closed to open position relative to said opening, said doors having vertical edge portions in the closed position being disposed in substantially contiguous relation, the improvement of a door closing and locking mechanism comprising;

a vertical locking bar for each of said doors, hinge means having a vertical axis substantially parallel to said door coupling said locking bar and door for rotation of said locking bar about said vertical axis, said locking bar including upper and lower locking cam means, keeper means mounted on said container engageable by said locking cam means, said bars each having a parallelogram wall construction and having a generally rectangular configuration in horizontal cross section and including a flat surface portion abutably engageable with said door and said vertical axis being laterally offset from said flat surface portion, said bars including an apertured wall in the closed position of said bars being disposed substantially normal to the door to which it is connected, a slide bolt assembly on each door disposed laterally with respect to each said bar, said assembly including a bracket, a slide bolt slideably supported on said bracket and movable into engagement with said apertured wall of an adjacent bar for locking said bar against rotation in the closed position of said door.

2. The invention in accordance with claim 1, said doors each including a second vertical locking bar rotatably connected to said door, said second bar including second upper and lower locking cam means, second upper and lower locking cam means on each container adapted to be engaged by said second cam means for locking said door, operating means on said second bars for rotating the same, and said second bars having a substantially square configuration in cross section.

3. A container having a loading opening including a pair of hinged doors swingable outwardly from closed to open position relative to said opening, said doors having vertical edge portions in the closed position being disposed in substantially contiguous relation, the improvement of a door closing and locking mechanism comprising;

a vertical locking bar rotatably connected to each said door, said locking bar including upper and lower locking cam means, keeper means mounted on said container engageable by said locking cam mans, said bars each having a parallelogram wall construction, including an apertured wall in the closed position of said bars being disposed substantially normal to the door to which it is connected, a slide bolt assembly on each door disposed laterally with respect to each said bar, said assembly including a bracket, a slide bolt slideably supported on said bracket and movable into engagement with said apertured wall of an adjacent bar for locking said bar against rotation in the closed position of said door, upper and lower hinge assemblies connecting each of said bars to said doors, each said assemblies including a hinge plate mounted on said door, a tubular vertical hinge bracket supported on each said plate, a second vertical wall on each bar parallel to said apertured wall havng upper and lower slots, upper and lower cylindrical hinge elements disposed in each slot and being respectively disposed and confined in upper and lower ends at each of said tubular hinge brackets.

4. The invention in accordance with claim 3, said cylindrical hinge elements each including an enlarged head portion connected to said second wall within said slot and including cylindrical bearing portions in said tubular hinge brackets.

5. A container havng a loading opening including a pair of hinged doors swingable outwardly from closed to open position relative to said opening, said doors having vertical edge portions in the closed position being disposed in substantially contiguous relation, the improvement of a door closing and locking mechanism comprising;

a vertical locking bar rotatably connected to each said door, said locking bar including upper and lower locking cam means, keeper means mounted on said container engageable by said locking cam means, said bars each having a parallelogram wall construction, including an apertured wall in the closed position of said bars being disposed substantially normal to the door to which it is connected, a slide bolt assembly on each door disposed laterally with respect to each said bar, said assembly including a bracket, a slide bolt slideably supported on said bracket and movable into engagement with said apertured wall of an adjacent bar for locking said bar against rotation in the closed position of said door, each of said bars having a second vertical wall parallel to said apertured wall with said second walls being laterally spaced and facing one another, a first tubular lock member on one of said second walls, a second tubular lock member on the other of said second walls, said first and second lock members in the lock position of said bars being in vertical registry and lock pin means removably positioned in said lock members for connecting together said locking bars in the closed position.

6. The invention in accordance with claim 5, including a third tubular lock member on one of said second walls disposed below said second lock member in registry therewith and being engaged by said lock pin.

7. The invention in accordance with claim 5, said first tubular lock members having an opening, said opening being adapted to receive said lock pin, whereby said lock pin provides leverage means for rotating said bar to which said first lock means is connected.

8. The invention in accordance with claim 6, said first and third lock members being connected to the same bar and said second lock member being disposed there between, said first lock member having a first opening for removably receiving said lock pin, said third lock member having a second opening for receiving said lock pin and disposed in laterally offset spaced relation relative to said first opening, and said lock pin within said openings providing leverage means for rotating said associated bar to a plurality of closing positions.

9. The invention in accordance with claim 8, said second tubular lock member including an opening for removably receiving said lock pin to provide leverage means for rotating the bar to which second lock member is connected.

10. The invention in accordance with claim 9, said second tubular lock member including a second opening laterally and vertically offset relative to said first opening for receiving said lock pin.

11. A container having a loading opening including a pair of hinged doors swingable outwardly from closed to open position relative to said opening, said doors having vertical edge portions in the closed position being disposed in substantially contiguous relation, the improvement of a door closing and locking mechanism comprising;

a vertical locking bar rotatably connected to each said door, said locking bar including upper and lower locking cam means, keeper means mounted on said container engageable by said locking cam means, a first tubular member on one of said bars adjacent said door edges, a second vertical tubular member on the other of said bars, said tubular members having vertical openings in registry in the closed position of said doors, and a removable lock pin disposed in said vertical openings for locking said bars against rotation.

12. The invention in accordance with claim 11, including slide bolt means on each of said doors, keeper elements on each of said bars engageable by said slide bolt means for locking said bars against rotation.

13. The invention in accordance with claim 12, said tubular members having horizontally extending openings engageable by said lock pin to provide leverage means for rotating said bars.

14. The invention in accordance with claim 1, said keeper means including upper and lower wall members connected to and projecting outwardly of said containers, a vertical outer wall connecting said upper and lower wall members, said upper and lower wall members each having a wall portion projecting laterally outwardly in opposite directions relative to said vertical wall, said locking cam means including a cam foot connected to each of the upper and lower ends of said locking bars and projecting laterally outwardly with respect thereto, and each cam foot having upper and lower gathering edges engageable with said upper and lower wall members.

15. The invention in accordance with claim 14, said cam foot comprising a hook shaped projection.

16. The invention in accordance with claim 14, said gathering edges comprising downwardly and upwardly sloping walls on said cam foot.

17. The invention in accordance with claim 16, including a stop member positioned on said container adjacent each keeper member in spaced relation thereto and adapted to be engaged by said cam foot in the locked position of said operating bars.

* * * * *